US011338580B2

(12) United States Patent
Makino et al.

(10) Patent No.: US 11,338,580 B2
(45) Date of Patent: May 24, 2022

(54) PRINTING APPARATUS AND PRINTING METHOD

(71) Applicant: Brother Kogyo Kabushiki Kaisha, Nagoya (JP)

(72) Inventors: Masahiro Makino, Nagoya (JP); Taro Nagano, Nagoya (JP); Daiki Kato, Seto (JP); Haru Inoue, Nagoya (JP); Jeongbin Lee, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 58 days.

(21) Appl. No.: 16/819,393

(22) Filed: Mar. 16, 2020

(65) Prior Publication Data

US 2020/0307191 A1 Oct. 1, 2020

(30) Foreign Application Priority Data

Mar. 29, 2019 (JP) ..... JP2019-066482

(51) Int. Cl.
*B41J 2/07* (2006.01)
*B41J 11/00* (2006.01)
*B41J 13/08* (2006.01)

(52) U.S. Cl.
CPC ..... *B41J 2/07* (2013.01); *B41J 11/007* (2013.01); *B41J 13/08* (2013.01)

(58) Field of Classification Search
CPC ..... B41J 29/38; B41J 2/04573; B41J 2/2146; B41J 11/008; B41J 11/007; B41J 2/155; B41J 13/08; B41J 2/07; B41J 13/02
See application file for complete search history.

(56) References Cited

U.S. PATENT DOCUMENTS 6,068,362 A 5/2000 Dunand et al.

FOREIGN PATENT DOCUMENTS

| | | | |
|---|---|---|---|
| EP | 3225399 | A1 | 10/2017 |
| EP | 3381689 | A2 | 10/2018 |
| JP | S61-209166 | A | 9/1986 |
| JP | H10-151774 | A | 6/1998 |
| JP | H11-207964 | A | 8/1999 |

OTHER PUBLICATIONS

Dec. 16, 2020—(EP) Search Report—App 20162657.9.
Apr. 26, 2021—(EP) Extended Search Report—App 20162657.9.

*Primary Examiner* — Jannelle M Lebron
(74) *Attorney, Agent, or Firm* — Banner & Witcoff, Ltd.

(57) ABSTRACT

A printing apparatus has a conveyance roller configured to convey a sheet in a first direction, an encoder provided at the conveyance roller, a head having a plurality of nozzles aligned in a second direction intersecting with the first direction and being configured to jet liquid to the sheet which is conveyed in the first direction by the conveyance roller and a controller having a power circuit configured to apply voltage to the head for jetting the liquid. The controller is configured to: determine a jetting frequency for the head based on a signal outputted from the encoder; and change an output voltage of the power circuit depending on the determined jetting frequency.

14 Claims, 8 Drawing Sheets

Fig. 8

| JETTING FREQUENCY (kHz) | BASE VOLTAGE (V) | JETTING SPEED BEFORE VOLTAGE CORRECTION (m/s) | CORRECTION VALUE (V) | JETTING SPEED AFTER VOLTAGE CORRECTION (m/s) |
|---|---|---|---|---|
| 1 | 23 | 9 | 1 | 10 |
| 10 | 23 | 9.5 | 0.5 | 10 |
| 20 | 23 | 10 | 0 | 10 |
| 30 | 23 | 9.5 | 0.5 | 10 |
| 40 | 23 | 8 | 1.5 | 10 |
| 50 | 23 | 6.5 | 2.5 | 10 |
| 60 | 23 | 8 | 1.5 | 10 |
| 70 | 23 | 9 | 1 | 10 |
| 80 | 23 | 10 | 0 | 10 |

Fig. 9

T

| JETTING FREQUENCY (kHz) | BASE VOLTAGE (V) | | | | | CORRECTION VALUE (V) | | | | |
|---|---|---|---|---|---|---|---|---|---|---|
| | 1st | 2nd | 3rd | 4th | 5th | 1st | 2nd | 3rd | 4th | 5th |
| 1 | 24 | 22 | 23 | 22 | 24 | 0 | 0 | 0 | 0 | 0 |
| 10 | 24 | 22 | 23 | 22 | 24 | -1.5 | 0.5 | -0.5 | 0.5 | -1.5 |
| 20 | 24 | 22 | 23 | 22 | 24 | -1 | -1 | -1 | -1 | 1 |
| 30 | 24 | 22 | 23 | 22 | 24 | -1 | 0 | -1 | 1 | 1.5 |
| 40 | 24 | 22 | 23 | 22 | 24 | 0 | -1 | 2 | 4 | 0 |
| 50 | 24 | 22 | 23 | 22 | 24 | 1 | 4 | 2.5 | 3.5 | -1.5 |
| 60 | 24 | 22 | 23 | 22 | 24 | -1 | 3 | 0 | 2 | 0 |
| 70 | 24 | 22 | 23 | 22 | 24 | 0 | 0 | 0 | 0 | 0 |
| 80 | 24 | 22 | 23 | 22 | 24 | -3 | 0 | -1 | 1 | -2 |

PRINTING APPARATUS AND PRINTING METHOD

CROSS REFERENCE TO RELATED APPLICATION

The present application claims priority from Japanese Patent Application No. 2019-066482 filed on Mar. 29, 2019, the disclosure of which is incorporated herein by reference in its entirety.

BACKGROUND

Field of the Invention

The present invention relates to a printing apparatus jetting ink from nozzles and a printing method utilizing the printing apparatus.

Description of the Related Art

There is known an ink jet printer including a motor driving a print object, a head jetting ink to the print object driven by the motor, and an encoder provided for the motor (see Japanese Patent Application Laid-open No. 10-151774). In such an ink jet printer, a signal is outputted from the encoder to indicate the speed of the print object, and the jetting frequency of the head is determined based on the speed of the print object.

SUMMARY

However, if the jetting frequency of the head is changed based on the speed of the print object, then the jetting speed of the liquid jetted from the head will change depending on the jetting frequency of the head, so as to cause a problem that density unevenness arises in the image printed on the print object.

An object of the present teaching is to provide a printing apparatus and a printing method where the jetting frequency of the head is changed based on the speed of a print object, and the density unevenness is made less likely to arise in an image being printed on the print object.

According to a first aspect of the present teaching, there is provided a printing apparatus including: a conveyance roller configured to convey a sheet in a first direction; an encoder provided at the conveyance roller; a head having a plurality of nozzles aligned in a second direction intersecting with the first direction, and being configured to jet liquid to the sheet which is conveyed in the first direction by the conveyance roller; and a controller having a power circuit configured to apply voltage to the head for jetting the liquid, wherein the controller is configured to: determine a jetting frequency for the head based on a signal outputted from the encoder; and change an output voltage of the power circuit depending on the determined jetting frequency.

According to a second aspect of the present teaching, there is provided a printing apparatus including: a conveyance roller configured to convey a sheet in a first direction; an encoder provided at the conveyance roller; a first head bar including a plurality of first heads configured to jet first liquid to the sheet which is conveyed in the first direction by the conveyance roller; and a controller having a first power circuit configured to apply voltage to each of the first heads for jetting the first liquid, wherein each of the first heads has a plurality of nozzles aligned in a second direction intersecting with the first direction, and the controller is configured to: determine a jetting frequency for each of the first heads based on a signal outputted from the encoder; and change an output voltage of the first power circuit depending on the determined jetting frequency.

According to a third aspect of the present teaching, there is provided a printing apparatus including: a conveyance roller configured to convey a sheet in a first direction; an encoder provided at the conveyance roller; a head having a plurality of nozzles aligned in a second direction intersecting with the first direction, and being configured to jet liquid to the sheet which is conveyed in the first direction by the conveyance roller; and a controller including a plurality of power circuits configured to apply voltage to the head for jetting the liquid, wherein a plurality of nozzle groups are formed in the head, the number of the power circuits is equal to or less than the number of the nozzle groups, any one of the power circuits is allocated to each of the nozzle groups, and the controller is configured to: determine a jetting frequency for the head based on a signal outputted from the encoder; and change allocation of the power circuits to the nozzle groups depending on the determined jetting frequency.

According to a fourth aspect of the present teaching, there is provided a printing method utilizing a printing apparatus including: a conveyance roller for conveying a sheet in a first direction; an encoder provided at the conveyance roller; a head having a plurality of nozzles aligned in a second direction intersecting with the first direction, and being for jetting liquid to the sheet which is conveyed in the first direction by the conveyance roller; and a controller having a power circuit for applying voltage to the head for jetting the liquid, the printing method executed by the controller including: determining a jetting frequency for the head based on a signal outputted from the encoder; and changing an output voltage of the power circuit depending on the determined jetting frequency.

In the printing apparatus according to the first to the third aspects of the present teaching and the printing method according to the fourth aspect of the present teaching, the controller is configured to determine the jetting frequency for the head based on the signal outputted from the encoder and, depending on the determined jetting frequency, either change the output voltage of the power circuit or change the allocation of the power circuits to the nozzle groups. Therefore, it is possible to maintain a constant jetting speed of droplets jetted from the nozzles independently from the jetting frequency, such that density unevenness is made less likely to arise in an image being printed on the sheet.

BRIEF DESCRIPTION OF THE DRAWINGS

FIG. 8 is a table showing an example of a correction value for the voltage set according to each jetting frequency.

FIG. 9 is an exemplary table stored in a non-volatile memory.

DESCRIPTION OF THE EMBODIMENT

Hereinbelow, referring to FIGS. 1 to 9, an explanation will be made on a printing apparatus according to an embodiment of the present teaching.

Figure 1:
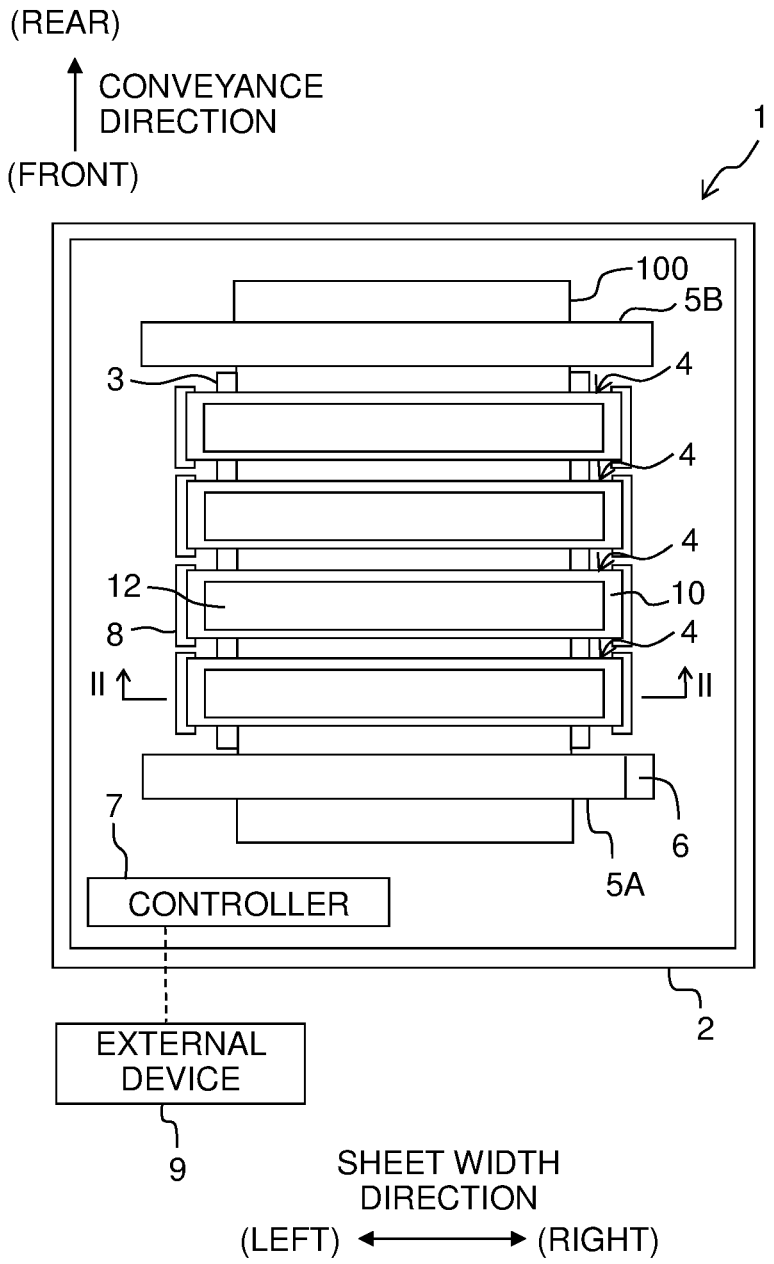
FIG. 1 is a plan view schematically showing a printing apparatus according to an embodiment of the present teaching.

In FIG. 1, the upstream side of a sheet 100 in a conveyance direction is defined as the front side of a printing apparatus 1, whereas the downstream side in the conveyance direction is defined as the rear side of the printing apparatus 1. Further, a left/right direction of the printing apparatus 1 is defined as a sheet width direction being orthogonal to the conveyance direction and parallel to the surface of the sheet 100 being conveyed (the surface parallel to the page surface of FIG. 1). Note that the left side of the figure is the left side of the printing apparatus 1 whereas the right side of the figure is the right side of the printing apparatus 1. Further, an up/down direction of the printing apparatus 1 is defined as the direction orthogonal to the conveyance surface of the sheet 100 (the direction orthogonal to the page surface of FIG. 1). In FIG. 1, the page front side is the upside whereas the page back side is the downside. Hereinbelow, the front, rear, left, right, up (or upper), and down (or lower) will be used appropriately for the explanation.

As shown in FIG. 1, the printing apparatus 1 includes a casing 2, a platen 3, four head bars 4, two conveyance rollers 5A and 5B, an encoder 6, and a controller 7.

The platen 3 is placed horizontal in the casing 2. On the upper surface of the platen 3, the sheet 100 is placed. The four head bars 4 are provided above the platen 3 to align in the front/rear direction. The two conveyance rollers 5A and 5B are arranged respectively at the front side and the rear side of the platen 3. The two conveyance rollers 5A and 5B are driven respectively by an unshown motor to convey the sheet 100 on the platen 3 frontward. That is, the front side of the printing apparatus 1 is the upstream side in the conveyance direction whereas the rear side is the downstream side in the conveyance direction. The encoder 6 is provided at the conveyance roller 5A on the upstream side in the conveyance direction.

The controller 7 includes non-volatile memories and the like such as a number of FPGAs (Field Programmable Gate Array; see FIG. 4), a ROM (Read Only Memory), a RAM (Random Access Memory), an EEPROM (Electrically Erasable Programmable Read-Only Memory), and the like. Note that the ROM, RAM, EEPROM and the like are unshown. Further, the controller 7 is connected with an external device 9 such as a PC or the like in a data communicable manner, to control every part of the printing apparatus 1 on the basis of print data sent from the external device 9.

For example, the controller 7 controls the motor driving the conveyance rollers 5A and 5B to convey the sheet 100 in the conveyance direction with the conveyance rollers 5A and 5B. Further, the controller 7 controls the head bars 4 to jet an ink to the sheet 100. By virtue of this, an image is printed on the sheet 100. Note that the sheet 100 may be a roll-like sheet composed of a supply roll including the upstream end in the conveyance direction and a retrieval roll including the downstream end in the conveyance direction. In such a case, the supply roll may be fitted on the conveyance roller 5A at the upstream side in the conveyance direction, and the retrieval roll be fitted on the conveyance roller 5B at the downstream side in the conveyance direction. Alternatively, the roll-like sheet may only have the supply roll including the upstream end in the conveyance direction. In such a case, the supply roll may be fitted on the conveyance roller 5A at the upstream side in the conveyance direction.

A number of head retainers 8 are fitted on the casing 2. The head retainers 8 are provided to align in the front/rear direction, and positioned above the platen 3 and between the two conveyance rollers 5A and 5B. The head retainers 8 retain the head bars 4 respectively.

The four head bars 4 jet the ink of four colors: cyan (C), magenta (M), yellow (Y), and black (K), respectively. Each of the head bars 4 is supplied with the ink of the corresponding color from an unsown ink tank.

Figure 2:
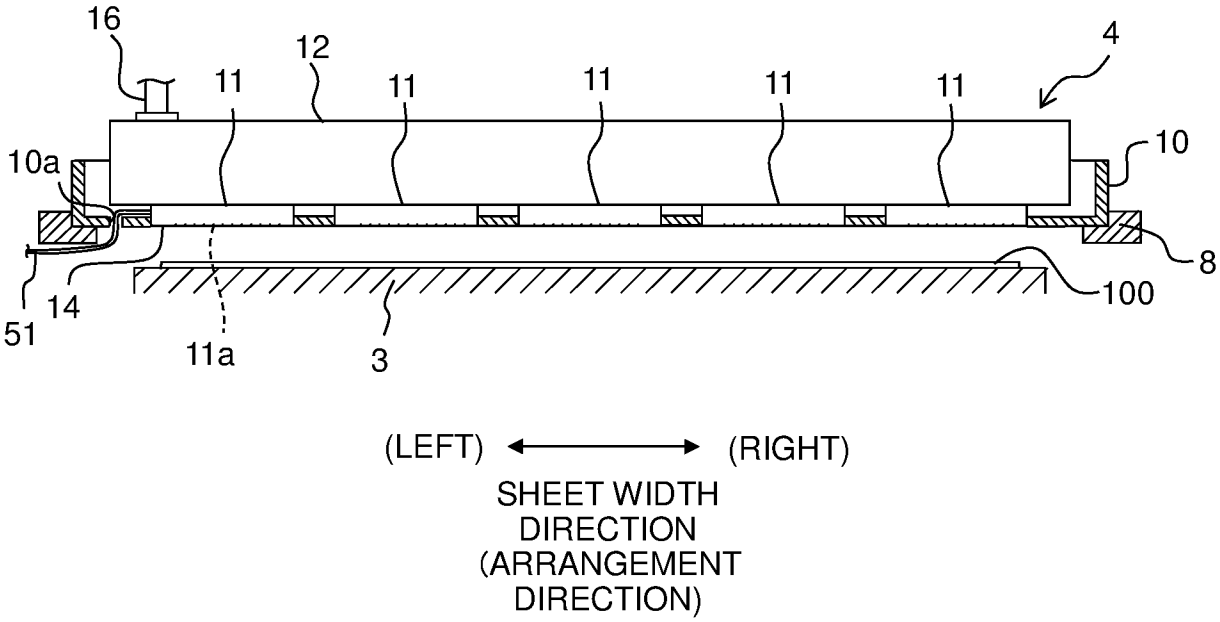
FIG. 2 is a cross section view along the line II-II shown in FIG. 1.
Figure 3:
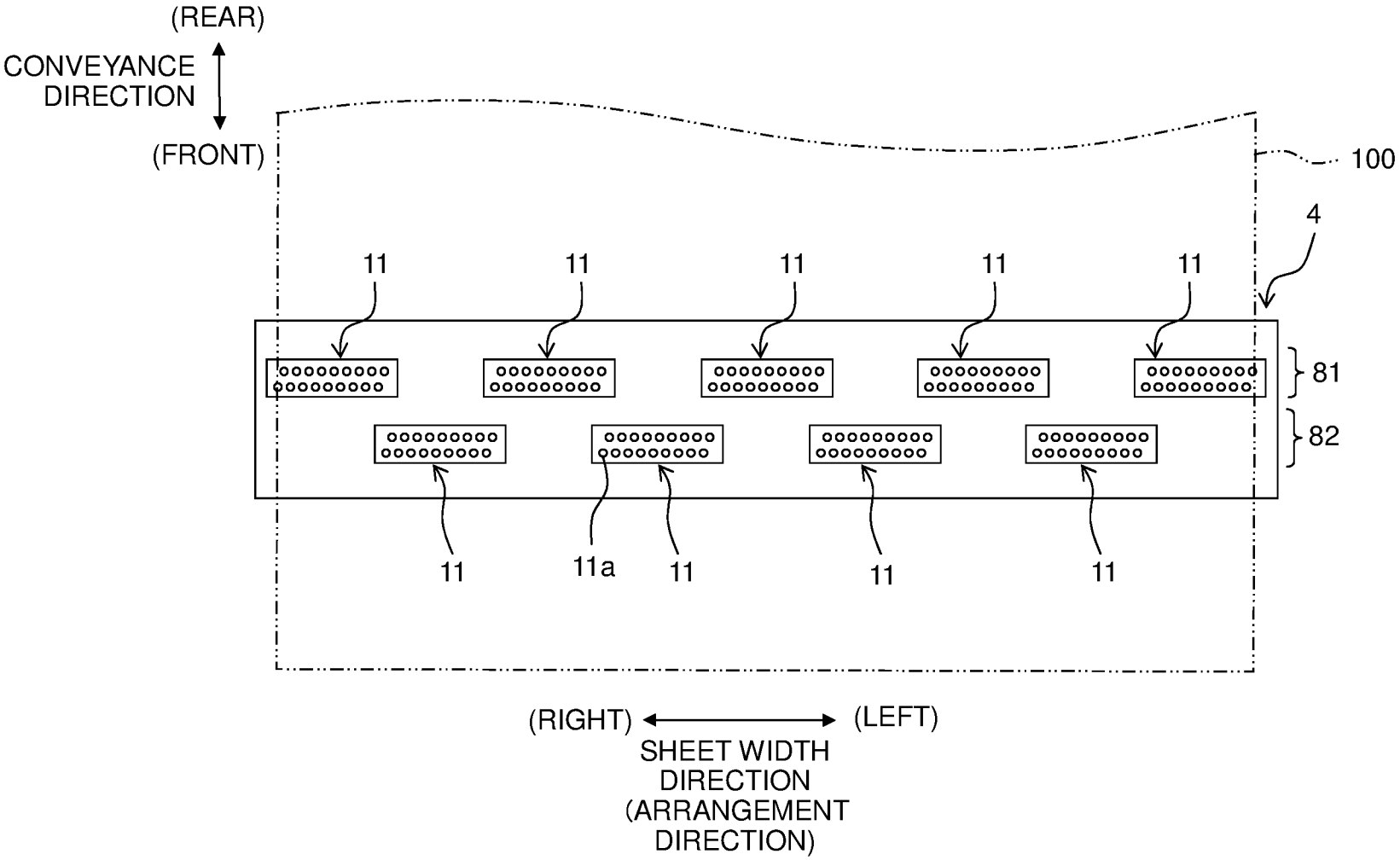
FIG. 3 is a bottom view of a head bar.

As shown in FIGS. 2 and 3, each of the head bars 4 includes a plate-like holder 10 elongated in the sheet width direction, a number of heads 11 fitted on the holder 10, and a reservoir 12.

A number of nozzles 11*a* are formed in the lower surface of each head 11. Each head 11 includes aftermentioned piezoelectric bodies 11*b* (see FIG. 6). The respective heads 11 are aligned along the sheet width direction which is the longitudinal direction of the head bar 4 to form a first head array 81 and a second head array 82. The first head array 81 and the second head array 82 are aligned in the conveyance direction, and the first head array 81 is positioned on the rear side of the second head array 82.

As shown in FIG. 3, the left end of each of the heads 11 of the first head array 81 is positioned at the same level in the left/right direction as the right end of one head 11 of the second head array 82. In other words, the left end of each of the heads 11 of the first head array 81 overlaps in the front/rear direction with the right end of one head 11 of the second head array 82.

As shown in FIG. 2, the holder 10 is provided with a slit 10*a*. The heads 11 are connected with the controller 7 via a flexible substrate 51 which is inserted through the slit 10*a*.

The heads 11 are arranged along an arrangement direction which is the sheet width direction. The heads 11 are arranged to separate alternately between the front side and the rear side in the conveyance direction. Between the heads 11 arranged on the front side and the heads 11 arranged on the rear side, there is positional deviation in the left/right direction (the arrangement direction). Note that in this embodiment, the heads 11 are arranged along a direction orthogonal to the conveyance direction (along the sheet width direction). However, the heads 11 may be arranged along a direction intersecting the conveyance direction at any angle other than 90 degrees, that is, obliquely.

As shown in FIGS. 1 and 2, the reservoir 12 is provided above the multiple heads 11. Note that FIG. 3 omits illustration of the reservoir 12.

The reservoir 12 is connected to the ink tank (not shown) via a tube 16 to temporarily retain the ink supplied from the ink tank. A lower part of the reservoir 12 is connected to the multiple heads 11 to supply the ink to the respective heads 11 from the reservoir 12.

Figure 4:
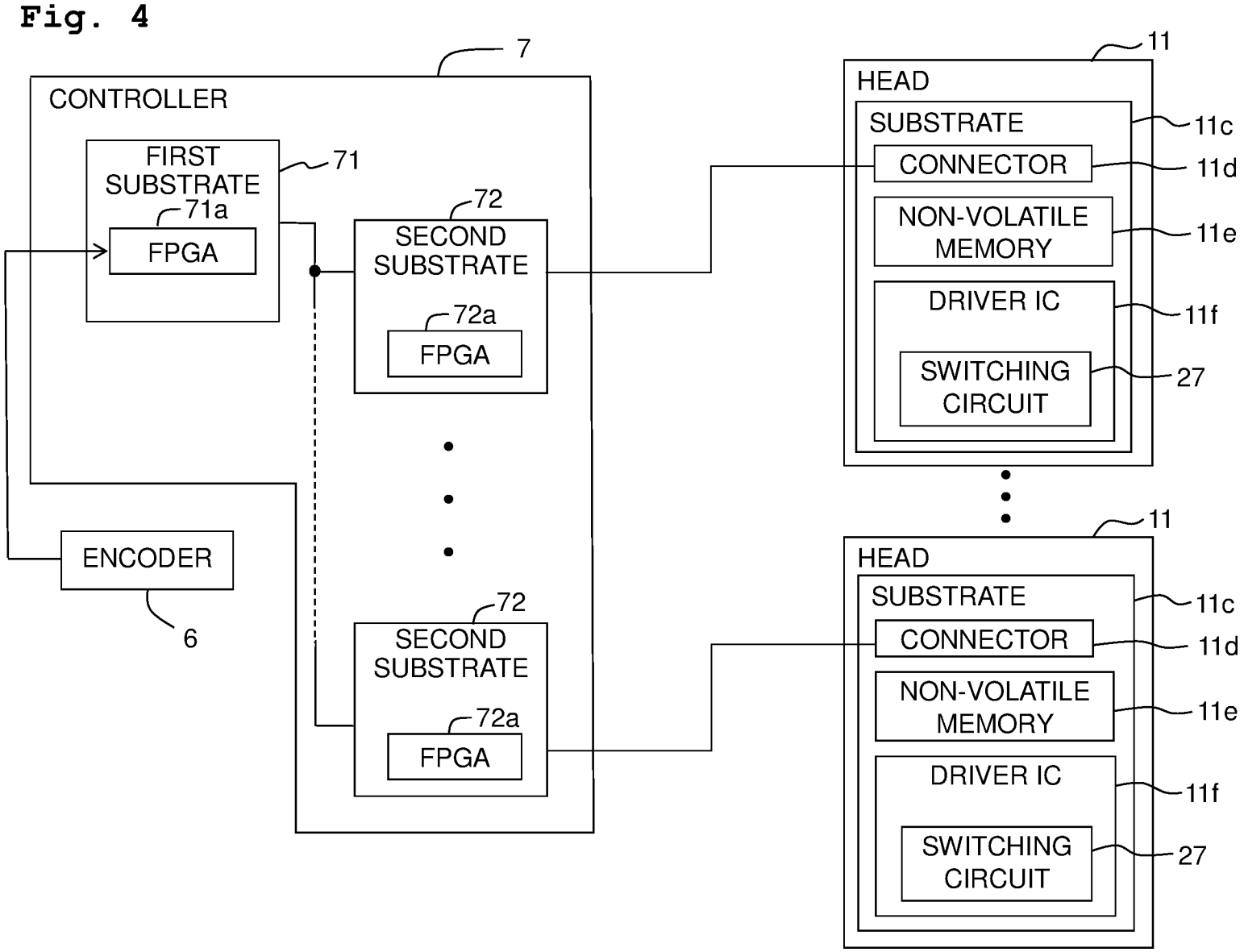
FIG. 4 is a block diagram schematically showing a connection of a controller and heads.

As shown in FIG. 4, the controller 7 includes a first substrate 71 and a number of second substrates 72. The first substrate 71 is provided with an FPGA 71*a*. Each second substrate 72 is provided with one FPGA 72*a*. The FPGA 71*a* is connected respectively to the multiple FPGAs 72*a* to control the driving of the FPGAs 72*a*. The FPGAs 72*a* correspond respectively to the heads 11, and the number of the FPGAs 72*a* is the same as the number of the heads 11. The FPGAs 72*a* are connected respectively with the heads 11. The FPGA 71*a* and the FPGAs 72*a* are connected to the RAM (not shown) functioning as a memory and the ROM (not shown) storing bit stream information.

Each of the heads 11 includes a substrate 11*c* and, on the substrate 11*c* are mounted a removable connector 11*d*, a non-volatile memory 11*e*, and a driver IC 11*f*. Each head 11 is connected to one second substrate 72 in a removable manner via the connector 11*d*. The driver IC 11*f* includes an aftermentioned switch circuit 27. Each driver IC 11*f* outputs a pulse signal as a drive signal to each of the nozzles 11*a*. Note that each of the output voltages of a first power circuit 21 to a fifth power circuit 25 is changed based on a jetting frequency as will be described later on, but the rise position and the fall position of the drive signal outputted from the driver IC 11*f* are not changed before and after the output voltage is changed.

Figure 5:
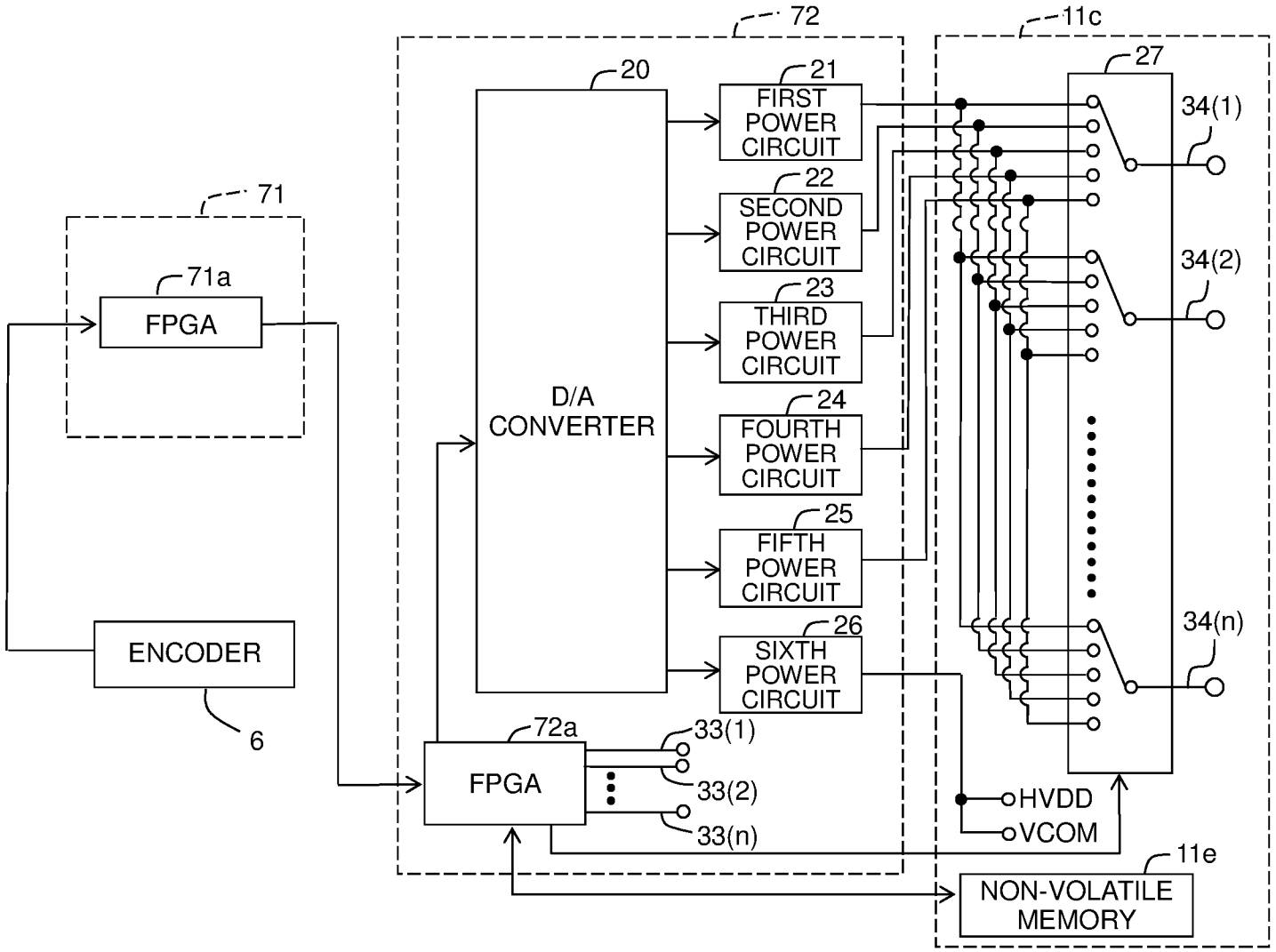
FIG. 5 is a block diagram schematically showing a configuration of the vicinity of a power source.

As shown in FIG. 5, the second substrate 72 is provided with a D/A (Digital/Analog) converter 20. Further, the second substrate 72 is provided with a number of power circuits and, in this embodiment, a first power circuit 21 to a sixth power circuit 26 are provided. The first power circuit 21 to the sixth power circuit 26 have FETs, electrical resistances and the like, and are capable of changing the output voltages. Switch-type DC/DC converters, for example, may be used as these first power circuit 21 to sixth power circuit 26. The FPGA 72*a* outputs a signal for setting the output voltages to the first power circuit 21 to the sixth power circuit 26 via the D/A converter 20.

The first power circuit 21 to the sixth power circuit 26 are connected to a first power supply wire 34(1) to an nth power supply wire 34(*n*) (n is a natural number larger than one) via the switch circuit 27. The switch circuit 27 connects each of the first power supply wire 34(1) to the nth power supply wire 34(*n*) to any one of the first power circuit 21 to the sixth power circuit 26. The first power circuit 21 to the fifth power circuit 25 are ordinary power circuits for ordinary usage. The sixth power circuit 26 is a specially devised power circuit. The sixth power circuit 26 is used as, for example, a power supply voltage for VCOM of drive elements, and an HVDD for a PMOS transistor 31 (the back gate voltage at the high voltage end).

The HVDD voltage is connected to the sixth power circuit 26 at a higher output voltage than the first power circuit 21 to the fifth power circuit 25 such that no electric current may flow to the parasitic diode of the PMOS transistor 31 at the high voltage end even if a higher voltage than a source terminal 31*a* of the PMOS transistor 31 is applied to a drain terminal 31*b*.

Figure 6:
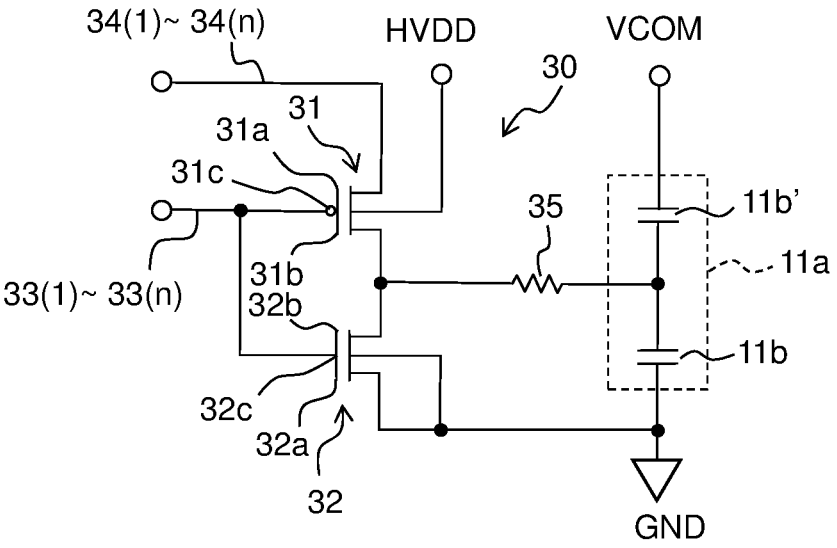
FIG. 6 is a circuit diagram schematically showing a configuration of a CMOS (Complementary Metal-Oxide-Semiconductor) circuit driving nozzles.

As shown in FIG. 6, the printing apparatus 1 includes a number of CMOS circuits 30 to drive the nozzles 11*a* respectively. The FPGA 72*a* outputs a gate signal to the CMOS circuits 30 via a first control wire 33(1) to an nth control wire 33(*n*) (n is a natural number larger than one). Note that the first control wire 33(1) to the nth control wire 33(*n*) correspond respectively to the first power supply wire 34(1) to the nth power supply wire 34(*n*). That is, the first control wire 33(1) corresponds to the first power supply wire 34(1), and the nth control wire 33(*n*) corresponds to the nth power supply wire 34(*n*).

The FPGA 72*a* outputs a signal to the switch circuit 27 for connecting each of the first power supply wire 34(1) to the nth power supply wire 34(*n*) to any one of the first power circuit 21 to the sixth power circuit 26. The FPGA 72*a* accesses the non-volatile memory 11*e* as necessary. The non-volatile memory 11*e* stores a number of nozzle addresses for identifying the respective nozzles 11*a*, an aftermentioned table T, and the like. Note that in this embodiment, 1,680 nozzles 11*a* are formed in each head 11, and the 1,680 nozzles 11*a* form seven nozzle groups. Then, any one of the first power circuit 21 to the fifth power circuit 25 is allocated to each nozzle group. Note that the number of nozzle groups is not limited to seven, but may be any number equal to or larger than the number of power circuits.

As shown in FIG. 6, the CMOS circuit 30 includes a PMOS (P-type Metal-Oxide-Semiconductor) transistor 31, an NMOS (N-type Metal-Oxide-Semiconductor) transistor 32, a resistance 35, two piezoelectric bodies 11*b* and 11*b*', and the like. The piezoelectric bodies 11*b* and 11*b*' function as capacitors. Note that providing only a single one piezoelectric body 11*b* may suffice. The source terminal 31*a* of the PMOS transistor 31 is connected to any one of the first power supply wire 34(1) to the nth power supply wire 34(*n*). A source terminal 32*a* of an NMOS transistor 32 is connected to the ground.

The drain terminal 31*b* of the PMOS transistor 31 and a drain terminal 32*b* of the NMOS transistor 32 are connected to one end of the resistance 35. The other end of the resistance 35 is connected to the other end of the one piezoelectric body 11*b*' and one end of the other piezoelectric body 11*b*. The one end of the one piezoelectric body 11*b*' is connected to the VCOM voltage, that is, the sixth power supply voltage while the other end of the other piezoelectric body 11*b* is connected to the ground.

A gate terminal 31*c* of the PMOS transistor 31 and a gate terminal 32*c* of the NMOS transistor 32 are connected to any one of the first control wire 33(1) to the nth control wire 33(*n*) corresponding to the power supply wire connected to the source terminal 31*a* of the PMOS transistor 31.

If the output signal at "L" is inputted from the FPGA 72*a* to the gate terminal 31*c* of the PMOS transistor 31 and the gate terminal 32*c* of the NMOS transistor 32, then the PMOS transistor 31 is electrically conducted such that the piezoelectric body 11*b* is (electrically) charged and the piezoelectric body 11*b*' is discharged. If the output signal at "H" is inputted from the FPGA 72*a* to the gate terminal 31*c* of the PMOS transistor 31 and the gate terminal 32*c* of the NMOS transistor 32, then the NMOS transistor 32 is electrically conducted such that the piezoelectric body 11*b* is discharged and the piezoelectric body 11*b*' is charged. By electrically charging and discharging the piezoelectric bodies 11*b* and 11*b*', the piezoelectric bodies 11*b* and 11*b*' are deformed to jet the ink from the nozzles 11*a*.

Next, referring to FIG. 7, an explanation will be made on a relationship between the jetting frequency and the jetting speed of the ink droplets jetted from a certain nozzle 11*a*, when a constant voltage is applied to the piezoelectric bodies 11*b* and 11*b*' corresponding to that certain nozzle 11*a*.

Figure 7:
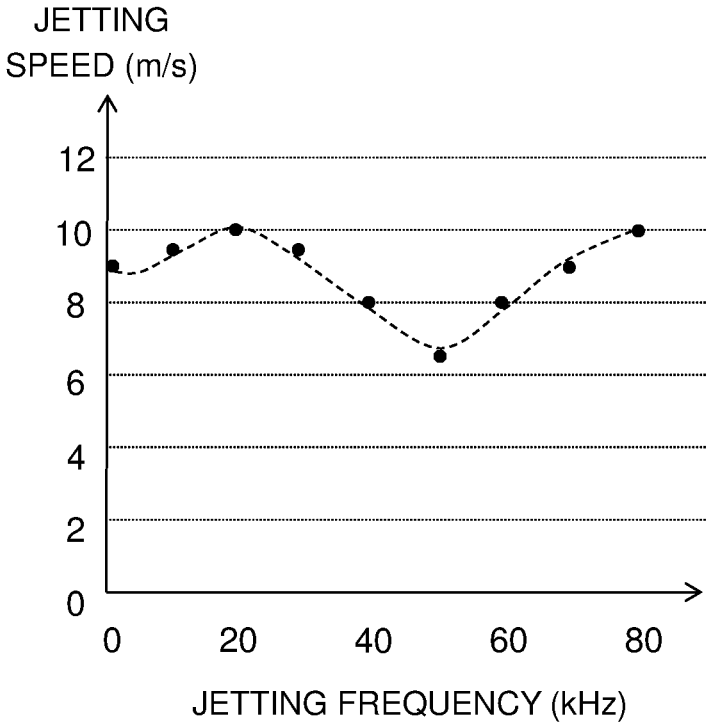
FIG. 7 is a graph showing a relationship between a jetting frequency and a jetting speed of ink droplets jetted from the nozzles, when a constant voltage is applied to a piezoelectric body.

As shown in FIG. 7, even if the constant voltage is applied for the certain nozzle 11*a*, the jetting speed of the ink droplets jetted from that nozzle 11*a* changes depending on the jetting frequency, and thus does not remain constant. In the example of FIG. 7, the jetting speed increases until the jetting frequency reaches 20 kHz, but decreases until the jetting frequency reaches 50 kHz after exceeding 20 kHz. Then, after the jetting frequency exceeds 50 kHz, the jetting speed increases again. It is conceivable that this is because the jetting speed of the ink droplets also depends on the length, the cross section area and/or the like of the channel of the nozzle 11*a*. That is, as shown in FIG. 7, the correlation between the jetting frequency and the jetting speed is built in the channel structure of the nozzle 11*a* such that the same correlation is also attainable in other nozzles 11*a* having the same channel structure as that nozzle 11*a*. Then, the change of the jetting speed along with change of the jetting frequency causes density unevenness of the image printed on the sheet 100. Further, generally speaking, the jetting speed of the ink droplets jetted from the nozzle 11*a* is in proportion to the voltage applied to the nozzle 11*a*.

In this embodiment, therefore, by correcting the voltage applied to the nozzle 11*a* depending on the jetting frequency, the jetting speed of the ink droplets jetted from the nozzle 11*a* is kept constant. The correction value for the voltage is, as shown in FIG. 8, set to maintain the jetting speed of the ink at a predetermined speed at each frequency after measuring the ink jetting speed at each predetermined frequency. FIG. 8 shows an example of correction values for the case where the power circuit whose base voltage value is 23 V is allocated to the nozzle 11*a* and, at each jetting frequency, the jetting speed is maintained at 10 m/s.

Note that in this embodiment, the four head bars 4 are aligned in the conveyance direction, and the encoder 6 is provided at the conveyance roller 5A on the upstream side in the conveyance direction. Further, each of the head bars 4 includes multiple heads 11. Then, the sheet 100 being conveyed by the conveyance roller 5A is accelerated. Therefore, depending on the distance from the encoder 6 in the conveyance direction, the speed of conveying the sheet 100 increases as compared to the point of time when the encoder 6 outputs the signal. Hence, if the same correction value is used in correction for the four head bars 4, then it is difficult to obtain appropriate jetting speeds for all heads 11. In this embodiment, therefore, for the heads 11 included in the head bars 4 arranged further downstream in the conveyance direction, the correction values are set larger. That is, the longer the distances between the encoder 6 and the head bars 4 in the conveyance direction, the larger the correction values set for the heads 11 included in those head bars 4.

Then, as shown in FIG. 9, the table T is stored in the non-volatile memory 11*e* of each head 11. Note that in FIG. 9, the "First" to the "Fifth" columns of the base voltage and the correction value denote the first power circuit 21 to the fifth power circuit 25, respectively. The table T stores the base voltage values of the first power circuit 21 to the fifth power circuit 25. Further, for each of the first power circuit 21 to the fifth power circuit 25, the correction values are associated with jetting frequencies.

Next, an explanation will be made on a procedure where for the respective heads 11, the controller 7 determines the jetting frequencies and, based on the determined jetting frequencies, changes the output voltages of the first power circuit 21 to the fifth power circuit 25 corresponding to the heads 11.

First, the FPGA 71*a* of the first substrate 71 of the controller 7 determines the jetting frequency of each of the heads 11 based on the signal outputted from the encoder 6 denoting the conveyance speed of the sheet 100. For example, an unshown non-volatile memory of the controller 7 may store a table associating the conveyance speeds of the sheet 100 with the jetting frequencies of the heads 11. Then, the FPGA 71*a* may read out from the table the jetting frequency corresponding to the conveyance speed of the sheet 100 denoted by the signal from the encoder 6. Alternatively, the FPGA 71*a* may substitute into a predetermined relational expression the conveyance speed of the sheet 100 denoted by the signal from the encoder 6, to calculate the jetting frequency of the head 11. Then, the FPGA 71*a* inputs the determined jetting frequency to the FPGA 72*a* of each second substrate 72.

Next, the FPGA 72*a* of each second substrate 72 refers to the table T stored in the non-volatile memory 11*e* of the corresponding head 11, and reads out the base voltage value of each of the first power circuit 21 to the fifth power circuit 25, and the correction value corresponding to the jetting frequency, inputted from the FPGA 71*a*, of each of the first power circuit 21 to the fifth power circuit 25. Then, the FPGA 72*a* adds the correction value to the base voltage value read out from the table T for each of the first power circuit 21 to the fifth power circuit 25 and, then, changes the output voltage to the summation of the base voltage value and the correction value. That is, the FPGA 72*a* outputs a signal setting the output voltage to the summation of the base voltage value and the correction value, to each of the first power circuit 21 to the fifth power circuit 25 via the D/A converter 20.

Next, an explanation will be made on a particular example where if the jetting frequency changes between 0 kHz and 80 kHz, then the FPGA 72*a* changes the output voltage of a certain power circuit so as to maintain the average value of the jetting speed to 10 m/s of the ink droplets jetted from a certain head 11. Note that while the explanation will be made below with the third power circuit 23 as an example, much the same is true on changing the output voltage of any other power circuit as changing the output voltage of the third power circuit 23.

As shown in FIG. 7, with the jetting frequency in the range from 0 kHz to 40 kHz and from 60 kHz to 80 kHz, the deviation between the jetting speed of ink droplets and the target jetting speed 10 m/s lies within 2 m/s. Therefore, if the jetting frequency stays within the range from 0 kHz to 40 kHz and from 60 kHz to 80 kHz, then FPGA 72*a* does not change the base voltage value 23 V of the third power circuit 23 but only changes the correction value depending on the jetting frequency.

On the other hand, with the jetting frequency in the range from 40 kHz to 60 kHz, the deviation between the jetting speed of ink droplets and the target jetting speed 10 m/s becomes larger than 2 m/s. Therefore, if the jetting frequency falls in the range from 40 kHz to 60 kHz, then FPGA 72*a* not only changes the correction value for the third power circuit 23 depending on the jetting frequency, but also changes the base voltage value 23 V of the third power circuit 23. In this case, 40 kHz is an example of the second threshold value of the present teaching, and 60 kHz is an example of the third threshold value of the present teaching.

Note that the controller 7 may receive print data from the external device 9 and, after driving the conveyance rollers 5A and 5B but before setting the jetting frequency to 20 kHz, inputs a drive signal for maintaining the heads 11 to carry out a maintenance process for the heads 11. On setting the jetting frequency to 20 kHz, the controller 7 may start a print process based on the received print data. In this case, 20 kHz is an example of the first threshold value of the present teaching. Further, with the jetting frequency in the range from 40 kHz to 60 kHz, the controller 7 may still carry out the maintenance process and, after setting the jetting frequency to 60 kHz, restart the print process based on the received print data. Note that the maintenance process includes a so-called flushing process, and/or a non-jet flushing process to vibrate the meniscuses without jetting the ink in the nozzles 11*a*.

According to the embodiment of the present teaching explained above, the controller 7 sets or determines the jetting frequency for each head 11 on the basis of the signal outputted from the encoder 6. Then, for each of the power circuits 21 to 25 corresponding respectively to the heads 11, the output voltage is changed based on the base voltage value read out from the non-volatile memory 11*e* and the correction value corresponding to the determined jetting frequency. By virtue of this, it is possible to maintain a constant jetting speed of the ink droplets independently from the jetting frequency, such that density unevenness can be made less likely to arise in the image being printed on the sheet 100.

Hereinabove, one embodiment of the present teaching was explained. However, the present teaching is not limited to the above embodiment but can undergo various design changes without departing from the scope set forth in the appended claims.

In this embodiment, a signal is inputted from the encoder 6 to the FPGA 71*a* of the first substrate 71 and, based on the signal from the encoder 6, the jetting frequency is determined for each head 11. However, without being limited to that, for example, the signal may be inputted from the encoder 6 to the FPGA 72*a* of each second substrate 72, such that the FPGA 72*a* may determine the jetting frequency for the corresponding head 11 on the basis of the signal from the encoder 6.

In this embodiment, the encoder 6 is provided at the conveyance roller 5A on the upstream side in the conveyance direction. However, the encoder 6 may be provided at the conveyance roller 5B on the downstream side in the conveyance direction.

In this embodiment, the FPGA 72*a* of each second substrate 72 changes the output voltage by adding a correction value to the base voltage value read out from the table T for each of the first power circuit 21 to the fifth power circuit 25. However, without being limited to that, for example, a thermistor may be provided for detecting the temperature of each head 11, and the non-volatile memory 11*e* of each head 11 may further store second correction values corresponding to the temperatures. Generally speaking, the higher the temperature of the head 11, the lower the viscosity of the ink in the head 11. Then, the lower the viscosity of the ink, the faster the jetting speed of the ink. Hence, the second correction values may be set smaller as the temperature of the head 11 detected by the thermistor rises. Then, the FPGA 72*a* may change the output voltage based on the second correction value, the correction value, and the base voltage value read out from the table T, for each of the first power circuit 21 to the fifth power circuit 25.

Alternatively, the non-volatile memory 11*e* of each head 11 may store another second correction values corresponding to printing rates. In such a case, the FPGA 71*a* of the first substrate 71 may calculate the printing rate of each head 11 on the basis of the print data inputted from the external device 9, and then input the same to the FPGA 72*a* of each second substrate 72. Generally speaking, the higher the printing rate of the head 11, the higher the temperature of the head 11, such that the ink viscosity in the head 11 is inclined to decrease. Then, the lower the ink viscosity, the faster the jetting speed of the ink. Therefore, the second correction values may be set smaller as the printing rate of the head 11 rises. Then, the FPGA 72*a* may change the output voltage based on this second correction value, the correction value, and the base voltage value read out from the table T, for each of the first power circuit 21 to the fifth power circuit 25.

In this embodiment, the FPGA 72*a* of each second substrate 72 changes the output voltage of each of the first power circuit 21 to the fifth power circuit 25 depending on the jetting frequency determined by the FPGA 71*a* of the first substrate 71. However, without being limited to that, for example, the FPGA 72*a* may not change the output voltage of each of the first power circuit 21 to the fifth power circuit 25 depending on the jetting frequency determined by the FPGA 71*a* of the first substrate 71, but may change the allocation of power circuit to each nozzle group.

The above explanation was made on the correction value for the case where the jetting speed of ink droplets is maintained at 10 m/s. However, without being limited to 10 m/s, for example, the jetting speed of ink droplets may be maintained at 9 m/s or 11 m/s.

What is claimed is:

1. A printing apparatus comprising:

a conveyance roller configured to convey a sheet in a first direction;

an encoder provided at the conveyance roller;

a head having:

a memory, and a plurality of nozzles aligned in a second direction intersecting with the first direction, and being configured to jet liquid to the sheet which is conveyed in the first direction by the conveyance roller; and a controller having a power circuit configured to apply voltage to the head for jetting the liquid, wherein the memory of the head stores a base voltage value and a plurality of correction values associated respectively with a plurality of jetting frequencies, for the power circuit, and wherein the controller is configured to:

determine a jetting frequency for the head based on a signal outputted from the encoder; and change an output voltage of the power circuit depending on the determined jetting frequency, wherein changing the output voltage includes:

reading out, from the memory, the base voltage value and a correction value corresponding to the determined jetting frequency, for the power circuit; and changing the output voltage of the power circuit based on the base voltage value and the correction value read out from the memory.

2. The printing apparatus according to claim 1, wherein the controller is configured to change the output voltage of the power circuit such that jetting speed of the liquid jetted from the nozzles is kept constant between before and after the output voltage of the power circuit is changed.

3. The printing apparatus according to claim 1, wherein the controller has a plurality of power circuits including the power circuit, and the base voltage value and the correction values associated respectively with the jetting frequencies are stored in the memory, for each of the power circuits.

4. The printing apparatus according to claim 3, wherein the head has a plurality of nozzle groups formed therein, and the number of the power circuits is equal to or less than the number of the nozzle groups.

5. The printing apparatus according to claim 3, wherein the controller is configured to:

drive the conveyance roller after receiving print data;

input a drive signal for maintaining the head, after driving the conveyance roller and before determining that the jetting frequency is a first threshold value; and control the head to start a print process based on the print data in a case of determining that the jetting frequency is the first threshold value.

6. The printing apparatus according to claim 5, wherein for each of the power circuits, the controller is configured to:

change the output voltage based on the base voltage value and a first correction value corresponding to the first threshold value which are read out from the memory, in a case of determining that the jetting frequency is the first threshold value; and change the first correction value without changing the base voltage value, after determining that the jetting frequency is the first threshold value and before determining that the jetting frequency is a second threshold value.

7. The printing apparatus according to claim 6, wherein for each of the power circuits, the controller is configured to:

change the base voltage value and the first correction value after determining that the jetting frequency is the second threshold value and before determining that the jetting frequency is a third threshold value; and change only the first correction value without changing the base voltage value after determining that the jetting frequency is the third threshold value.

8. The printing apparatus according to claim 6, wherein the controller is configured to:

control the head to stop the print process and input the drive signal for maintaining the head after determining that the jetting frequency is the second threshold value and before determining that the jetting frequency is a third threshold value; and restart the print process after determining that the jetting frequency is the third threshold value.

9. The printing apparatus according to claim 1, further comprising a thermistor configured to detect the temperature of the head, wherein the memory stores a plurality of second correction values associated respectively with temperatures, for the power circuit, and the controller is configured to:

read out, from the memory, the base voltage value of the power circuit, the correction value corresponding to the jetting frequency determined, and a second correction value corresponding to a temperature of the head detected by the thermistor; and change the output voltage of the power circuit based on the base voltage value, the correction value and the second correction value read out from the memory.

10. The printing apparatus according to claim 9, wherein the second correction values are set to be smaller as the temperature of the head detected by the thermistor rises.

11. The printing apparatus according to claim 1, wherein the controller is configured to calculate a printing rate of the head based on print data, the memory stores a plurality of second correction values associated with printing rates, for the power circuit, and the controller is configured to:

read out, from the memory, the base voltage value of the power circuit, the correction value corresponding to the jetting frequency determined, and a second correction value corresponding to the printing rate calculated; and change the output voltage of the power circuit based on the base voltage value, the correction value and the second correction value read out from the memory.

12. The printing apparatus according to claim 11, wherein the second correction values are set to be smaller as the printing rate rises.

13. The printing apparatus according to claim 1, wherein the controller is configured to input a pulse drive signal to the head to drive each of the nozzles, and a rise position and a fall position of the pulse drive signal before the output voltage of the power circuit is changed are respectively same as a rise position and a fall position of the pulse drive signal after the output voltage of the power circuit is changed.

14. A printing method utilizing a printing apparatus including: a conveyance roller for conveying a sheet in a first direction; an encoder provided at the conveyance roller; a head having a memory and a plurality of nozzles aligned in a second direction intersecting with the first direction, and being for jetting liquid to the sheet which is conveyed in the first direction by the conveyance roller; and a controller having a power circuit for applying voltage to the head for jetting the liquid, wherein the memory of the head stores a base voltage value and a plurality of correction values associated respectively with a plurality of jetting frequencies, for the power circuit, the printing method executed by the controller comprising:

determining a jetting frequency for the head based on a signal outputted from the encoder; and changing an output voltage of the power circuit depending on the determined jetting frequency, wherein changing the output voltage includes:

reading out, from the memory, the base voltage value and a correction value corresponding to the determined jetting frequency, for the power circuit; and changing the output voltage of the power circuit based on the base voltage value and the correction value read out from the memory.

* * * * *